US005994043A

United States Patent [19]

Bringley et al.

[11] Patent Number: 5,994,043

[45] Date of Patent: Nov. 30, 1999

[54] COLOR PHOTOGRAPHIC FILM WITH INVERTED BLUE RECORDING LAYERS

[75] Inventors: Joseph F. Bringley; James A. Friday; Roger A. Bryant, all of Rochester, N.Y.

[73] Assignee: Eastman Kodak Company, Rochester, N.Y.

[21] Appl. No.: 09/286,634

[22] Filed: Apr. 5, 1999

[51] Int. Cl.[6] ..... G03C 1/035; G03C 1/46

[52] U.S. Cl. ..... 430/506; 430/504; 430/507; 430/567

[58] Field of Search ..... 430/567, 504, 430/506, 507

[56] References Cited

U.S. PATENT DOCUMENTS

| | | | |
|---|---|---|---|
| 4,388,401 | 6/1983 | Hasebe et al. | 430/505 |
| 4,640,890 | 2/1987 | Fujita et al. | 430/504 |
| 4,751,174 | 6/1988 | Toya | 430/502 |
| 5,275,929 | 1/1994 | Buitano et al. | 430/567 |
| 5,300,413 | 4/1994 | Sutton et al. | 430/503 |
| 5,302,499 | 4/1994 | Merrill et al. | 430/503 |
| 5,314,793 | 5/1994 | Chang et al. | 430/506 |

*Primary Examiner*—Mark F. Huff
*Attorney, Agent, or Firm*—Carl O. Thomas

[57] ABSTRACT

A color photographic element is disclosed containing in its blue recording layer unit a blue light reflective layer positioned to receive light from first and second latent image forming layers in the blue recording layer unit. The first layer overlies the second layer and contains a silver coating coverages in the range of from 0.1 to 0.7 g/m$^2$. The second layer contains latent image forming silver halide grains of maximum sensitivity. The blue light reflective layer is free of blue absorbing dye and contains tabular silver halide grains have a thickness in the range of from 0.12 to 0.15 $\mu$m, an average aspect ratio of greater than 15, and a coating coverage of 0.5 to 1.5 g/m$^2$, and are formed of greater than 50 mole percent bromide, based on silver.

12 Claims, No Drawings

COLOR PHOTOGRAPHIC FILM WITH INVERTED BLUE RECORDING LAYERS

FIELD OF THE INVENTION

Color photographic elements are disclosed that exhibit increased blue contrast. Specifically, the invention relates to color photographic elements that employ radiation-sensitive silver halide emulsions in the blue and minus blue recording layer units.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{111} tabular" in referring to grains and emulsions indicates those in which the tabular grains have parallel major crystal faces lying in {111} crystal planes.

The term "high bromide" in referring to grains and emulsions indicates that bromide is present in a concentration greater than 50 mole percent, based on total silver.

In referring to silver halide grains and emulsions containing two or more halides, the halides are named in order of ascending concentrations.

The terms "blue", "green" and "red" indicate the portions of the visible spectrum lying, respectively, within the wavelength ranges of from 400 to 500 nm, 500 to 600 nin and 600 to 700 nm.

The term "minus blue" indicates the visible portion of the spectrum outside the blue portion of the spectrum—e.g., any spectral region in the range of from 500 to 700 nm.

The term "half peak absorption bandwidth" indicates the spectral region over which a dye exhibits an absorption equal to at least half its peak absorption.

The terms "front" and "back" indicate a position that is nearer or farther, respectively, than the support from the source of exposing radiation.

The terms "above" and "below" indicate a position nearer or farther, respectively, from the source of exposing radiation.

The term "subject" designates the person(s) and/or object (s) photographed.

The term "stop" in comparing photographic speeds indicates an exposure difference of 0.3 log E required to produce the same reference density, where E is exposure in lux-seconds.

The term "maximum gamma" herein defined as the highest observed ratio of $\Delta D/\Delta E$, where $\Delta D$ is the increase in density that occurs in response to an increase in exposure $\Delta E$. Contrast is the integration of gammas over a selected exposure range of interest.

BACKGROUND OF THE INVENTION

Photographic images that allow recreation or approximation of the natural hues of a subject are conventionally captured on photographic film mounted in a camera. Camera speed films typically employ high bromide silver halide emulsions. Separate images of each of blue, green and red exposures arc captured in blue, green and red recording layer units within the film. The blue recording layer unit contains chemically sensitized high bromide grains that may rely on native blue sensitivity or be sensitized to the blue region of the spectrum with one or more blue absorbing spectral sensitizing dyes. The green recording layer unit contains chemically sensitized high bromide grains that are sensitized to the green region of the spectrum with one or more green absorbing spectral sensitizing dyes. The red recording layer unit contains chemically sensitized high bromide grains that are sensitized to the red region of the spectrum with one or more red absorbing spectral sensitizing dyes. Dye-forming couplers are typically included in the layer units to allow dye images of distinguishable hue to be formed upon color processing. When the photographic film is intended for reversal processing to produce a viewable color positive image or when the photographic film is intended for use in exposing a color paper, the blue, green and red recording layer units contain couplers that form blue absorbing (yellow), green absorbing (magenta), and red absorbing (cyan) image dyes, respectively. When the dye image information is intended to be retrieved from the photographic film by digital scanning, the dye images can be of any hue, provided they are distinguishable.

The components used to construct color photographic films are disclosed in *Research Disclosure*, Vol. 389, September 1996, Item 38957. *Research Disclosure* is published by Kenneth Mason Publications, Ltd., Dudley House, 12 North St., Emsworth, Hampshire P010 7DQ, England. The following topics of Item 38957 are particularly pertinent to the present invention:

I. Emulsion grains and their preparation
(note most particularly the last sentence of paragraph (1) of B. Grain morphology);
II. Vehicles, vehicle extenders, vehicle-like addenda and vehicle related addenda;
IV. Chemical sensitization;
V. Spectral sensitization and desensitization
A. Sensitizing dyes;
X. Dye image formers and modifiers
(except A. silver dye bleach);
XI. Layers and layer arrangements;
XII. Features applicable only to color negative;
XIII. Features applicable only to color positive
(except C. Color positives derived from color negatives);
XV. Supports.

Sutton et al U.S. Pat. No. 5,300,413 discloses high bromide {111} tabular grain emulsions with grain dispersitics and thicknesses controlled to facilitate blue light reflection.

*Research Disclosure* Item 38957, I., cited above, E. Blends, layers and performance categories, (7) discusses the common practice of dividing a recording layer unit into two, three or more emulsion layers differing in speed. Typically, when this is done, the emulsion layer of the highest sensitivity is coated to first receive exposing radiation, since this increases speed. Paragraph (7) also notes, "When a slower emulsion layer is coated over a faster emulsion, increased contrast is obtained."

RELATED APPLICATION

Applicants' co-pending, commonly assigned patent application U.S. Ser. No. 09/283,739, filed Apr. 1, 1999, (Docket 78742) titled COLOR PHOTOGRAPHIC FILM EXHIBITING INCREASED BLUE SPEED is directed to a color photographic element containing in its blue recording layer unit a blue light reflective layer positioned to receive light from a layer in the blue recording layer unit containing latent image forming silver halide grains of maximum sensitivity. The blue light reflective layer is free of blue absorbing dye and contains tabular silver halide grains having a thickness in the range of from 0.12 to 0.15 $\mu$m, an average aspect ratio of greater than 15, and a coating coverage of 0.5 to 1.5 g/m$^2$, and are formed of greater than 50 mole percent bromide, based on silver.

PROBLEM TO BE SOLVED

Although it is generally known that the contrast of a photographic image can be increased by coating a slower emulsion layer over a faster emulsion layer, this approach to increasing contrast has not been widely used, since it has been recognized that this "inversion" of the customary sequence of emulsion layers improves contrast at the expense of imaging speed.

SUMMARY OF THE INVENTION

The present invention is directed to color photographic elements in which the blue record is increased in contrast with little, if any, loss in blue speed. This is achieved by inverting the commonly used fast over slow emulsion layer sequence in combination with other construction features set forth below.

In one aspect this invention is directed to a color photographic element comprised of a transparent film support and, coated on the support, blue, green and red recording layer units containing couplers that form first, second and third image dyes, respectively, the blue recording layer unit being coated to receive exposing radiation prior to the green and red recording layer units, each of the layer units containing radiation-sensitive silver halide grains for forming a developable latent image upon imagewise exposure containing greater than 50 mole percent bromide, based on silver, each of the first, second and third image dyes exhibiting a half-peak absorption bandwidth that occupies at least one 25 nm spectral region not occupied by the remaining of the first, second and third image dyes, wherein, the blue recording layer unit contains at least three layers, first and second layers of the three layers containing the radiation-sensitive silver halide grains for forming a developable latent image in reactive association with the coupler that forms the first image dye, the first layer being positioned to receive exposing radiation prior to the second layer and the radiation-sensitive silver halide grains in the first layer having a lower maximum sensitivity than the radiation-sensitive silver halide grains in the second layer, the silver coating coverage of the first layer being in the range of from 0.1 to 0.7 g/m$^2$, and, positioned to receive exposing radiation after the second layer, a blue light reflective layer that is free of blue absorbing dye and contains tabular silver halide grains having a thickness in the range of from 0.12 to 0.15 $\mu$m, an average aspect ratio of greater than 15, and a coating coverage of 0.5 to 1.5 g/m$^2$, and formed of greater than 50 mole percent bromide, based on silver.

DETAILED DESCRIPTION OF THE INVENTION

A simple construction of a color photographic element satisfying the requirements of the invention is illustrated by the following:

| (I) |
|---|
| Protective Overcoat |
| Blue Recording Layer Unit |
| Green Recording Layer Unit |
| Red Recording Layer Unit |
| Antihalation Layer Unit |
| Transparent Film Support |

Each of the blue, green and red recording layer units incorporate high bromide silver halide grains for latent image formation upon imagewise exposure. The high bromide grains preferably each contain greater than 70 mole percent bromide and optimally greater than 90 mole percent bromide, based on total silver. The grains can form latent image sites at the surface of the grains, internally or at both locations, but preferably form latent image sites primarily at the surface of the grains. The portion of the silver halide not accounted for by silver bromide can be any convenient conventional concentration of silver iodide and/or chloride. Silver iodide can be present up to its solubility limit in silver bromide, typically cited as 40 mole percent, based on total silver. However, iodide concentrations of less than 20 mole percent are preferred and iodide concentrations of less than 10 mole percent, based on total silver, are most preferred. Silver chloride concentrations are preferably limited to less than 30 mole percent and optimally less than 10 mole percent, based on total silver. Silver iodobromide grain compositions are specifically preferred. Other contemplated grain compositions include silver bromide, silver chlorobromide, silver iodochlorobromide and silver chloroiodobromide. The latent image forming silver halide gains can take the form of those disclosed in *Research Disclosure*, Item 38957, cited above, I. Emulsion grains and their preparation.

In a specifically preferred form the latent image forming silver halide grains in at least the minus blue (i.e, green and red) recording layer units are provided by chemically and spectrally sensitized {111 } tabular grain emulsions. Similar latent image forming silver halide grains can be employed in the blue recording layer unit, although non-tabular grain emulsions arc often used in the blue recording layer unit for latent image formation in combination with minus blue layer units that incorporate tabular gain latent image forming emulsions. Specific illustrations of high bromide tabular grain emulsions are provided by the following patents, here incorporated by reference:

List T

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubenidiek et al U.S. Pat. No. 4,672,027;
Yamada et al U.S. Pat. No. 4,679,745;
Daubendiek et al U.S. Pat. No. 4,693,964;

Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Daubendiek et al U.S. Pat. No. 5,576,168;
Olm et al U.S. Pat. No. 5,576,171;
Deaton et al U.S. Pat. No. 5,582,965;
Maskasky U.S. Pat. No. 5,604,085;
Reed et al U.S. Pat. No. 5,604,086;
Eshelman et al U.S. Pat. No. 5,612,175;
Levy et at U.S. Pat. No. 5,612,177;
Wilson et al U.S. Pat. No. 5,614,358;
Eshelman et al U.S. Pat. No. 5,614,359;
Maskasky U.S. Pat. No. 5,620,840;
Wen ct al U.S. Pat. No. 5,641,618;
Irving et al U.S. Pat. No. 5,667,954;
Maskasky U.S. Pat. No. 5,667,955;
Maskasky U.S. Pat. No. 5,691,131;
Maskasky U.S. Pat. No. 5,693,459;
Black et a1 U.S. Pat. No. 5,709,988;
Jagannathan et al U.S. Pat. No. 5,723,278;
Deaton et al U.S. Pat. No. 5,726,007;
Irving et al U.S. Pat. No. 5,728,515;
Bryant et al U.S. Pat. No. 5,728,517;
Maskasky U.S. Pat. No. 5,733,718;
Jagannathan et al U.S. Pat. No. 5,736,312;
Antoniades et al U.S. Pat. No. 5,750,326;
Brust et al U.S. Pat. No. 5,763,151; and
Maskasky et al U.S. Pat. No. 5,792,602.

Typically the {111} tabular grain emulsions are those in which the {111} tabular grains account for greater than 50 percent, preferably 70 and optimally 90 percent, of total grain projected area. High bromide emulsions in which {111} tabular grains account for substantially all (>97%) of total grain projected area are disclosed in the patents of List T cited above and are specifically contemplated. The {111} tabular grains preferably have an average thickness of less than 0.3 μm and most preferably less than 0.2 μm. It is specifically contemplated to employ ultrathin tabular grain emulsions in which the tabular grains having a thickness of less than 0.07 μm account for greater than 50 percent of total grain projected area.

When tabular grain emulsions are relied upon for latent image formation in the blue recording layer unit, they can have the thickness characteristics noted above. However, to obtain speed by absorption of blue light within the grains, it is recognized that the tabular grains having a thickness of up to 0.50 μm can account for at least 50 percent of total grain projected area in the blue recording layer units.

The high bromide {111} tabular grains preferably have an average aspect ratio of at least 5, most preferably greater than 8. Average aspect ratios can range up to 100 or higher, but are typically in the range of from 12 to 60. The average ECD of the latent image forming emulsions is typically less than 10 μm, with mean ECD's of less than 6 μm being particularly preferred to maintain low levels of granularity.

The latent image forming high bromide emulsions are chemically sensitized. Any of the chemical sensitizations of *Research Disclosure*, Item 38957, IV. Chemical sensitization, cited above as well as the patents, incorporated by reference, of List T, above, can be employed. One or a combination of sulfur, selenium and gold sensitizations arc commonly employed. Additionally, the epitaxial sensitization of the grains is contemplated.

In all instances the latent image forming grains in the minus blue recording layer units are spectrally sensitized. The green recording layer unit contains one or a combination of green absorbing spectral sensitizing dyes adsorbed to the surfaces of the latent image forming grains. The red recording layer unit contains one or a combination of red absorbing spectral sensitizing dyes adsorbed to the surfaces of the latent image forming grains. The latent image forming grains of the blue recording layer unit can rely entirely on native blue absorption, particularly when the grains contain iodide. Preferably the blue recording layer unit contains one or a combination of blue absorbing spectral sensitizing dyes adsorbed to the surfaces of the latent image forming grains. Spectral sensitizing dyes and dye combinations can take the forms disclosed in *Research Disclosure*, Item 38957, V. Spectral sensitization and desensitization, A. sensitizing dyes, and in the patents, here incorporated by reference of List T.

In addition to silver halide grains the dye image forming layer units contain dye image-forming couplers to produce image dyes following imagewise exposure and color processing. When the photographic elements are intended to be used for exposing a color paper or to form viewable reversal color images, the blue, green and red recording layer units contain dye-forming couplers that form on coupling yellow, magenta and cyan image dyes, respectively. When the photographic elements are intended to be scanned, an image dye of any convenient hue can be formed in any of the blue, green and red recording layer units, provided that the image dyes can be differentiated by inspection or scanning. To facilitate scanning each image dye is contemplated to exhibit a halfpeak absorption bandwidth of at least 25 nm, preferably 50 nm, that does not overlap the half peak absorption bandwidth of any image dye in another recording layer unit. Dye image-forming couplers can take any of the various forms disclosed in *Research Disclosure*, Item 38957, X. Dye image formers and modifiers, B. Image-dye-forming couplers.

The blue recording layer unit of (I) above is divided into at least two layers:

| (II) |
| --- |
| First Latent Image Forming Layer |
| Second Latent Image Forming Layer |
| Reflective Layer |

First and second latent image forming layers arc constructed as described above with the further requirement that the radiation-sensitive silver halide grains in the first layer have a lower maximum sensitivity than the radiation-sensitive silver grains in the second layer. Thus, the first and second layer arrangement is an inversion of the customary practice of coating a faster latent image forming layer over a slower latent image forming layer within a recording layer unit. In the conventional fast over slow layer arrangements the faster layer exhibits a speed ranging from one to three stops faster than slower underlying layer. This same relative speed relationship is also useful in the practice of this invention. However, any lower speed of the first layer as compared to the speed of the second layer is capable of increasing contrast and is within the contemplation of the invention. Since it customary to substantially optimally (for quantification see Kofron et al U.S. Pat. No. 4,439,520) chemically and spectrally sensitize radiation-sensitive emulsions, the average ECD of the radiation-sensitive silver halide grains in the first layer is preferably less than the average ECD of the radiation-sensitive silver halide grains in the second layer.

As demonstrated in the Examples below, if an inversion of the slower and faster latent image forming layers of a fast over slow coating arrangement is undertaken without other changes being introduced, contrast is increased, but a large degradation of imaging speed is encountered. It has been discovered that employing the inverted layer arrangement in combination with two other features allows a high degree of contrast with little or no sacrifice in imaging speed.

One of the other features employed to realize the advantages of the invention is that the silver coating coverage of the first latent image forming layer of (II) is limited to 0.7 $g/m^2$, preferably 0.6 $g/m^2$, or less. The minimum silver coating coverage of the first layer is generally at least 0.1 $g/m^2$, preferably at least 0.2 $g/m^2$.

The second other feature employed to realize the advantages of the invention reflective layer of (II) above. The reflective layer contains high bromide tabular grains. To perform a blue light reflecting function the high bromide tabular grains can take any of the silver halide compositions described above for the image recording layer units. Additionally, the silver halide grains in the reflective layer are free of any blue absorbing dye, notably any blue absorbing spectral sensitizing dye.

To facilitate blue light reflection, the blue light reflective layer contains tabular silver halide grains having a selected thickness range of from 0.12 to 0.15 $\mu$m. In this thickness range the tabular grains reflect blue light to a much greater degree than minus blue light. Significant blue speed enhancement can be realized with tabular grains in the selected thickness range coated at coverages as low 0.5 $g/m^2$. Tabular grains in the selected thickness range are contemplated to be coated in coverages ranging up to 1.5 $g/m^2$. Higher coating coverages are possible, but are efficient only for very specialized applications.

The tabular grains in the selected thickness range are further chosen to exhibit an average aspect ratio of greater than 15, preferably greater than 20, and most preferably greater than 30. Thus, the average ECD of these grains is in all instances greater than 1.8 $\mu$m. It is generally taught that latent image forming tabular grains should have an average ECD of no higher than 10 $\mu$m, since granularity is unacceptably high above this level for most, if not all, imaging applications. This restriction on maximum average ECD has no applicability to any of the silver halide grains in the reflective layer when none of these grains cause a dye image to be formed and hence have no impact on image granularity in the recording layer units. Thus, the maximum ECD of the tabular grains of selected thickness can range up the limits of convenience for emulsion preparation. For example, average ECD's of up to 15 or even 20 $\mu$m are contemplated. As the average ECD of the grains increases, the proportion of the grains accounted for by the edges (e.g., the proportion of the grain volume that lies within 0.1 $\mu$m of an edge) is reduced, and the specularity of light transmission and reflection is enhanced. This contributes to increasing image sharpness in the blue and minus blue recording layer units.

It is possible to employ in the reflective layer high bromide tabular grains in the selected thickness range that are present with silver halide grains that are non-tabular or are tabular but exhibit thicknesses outside the selected thickness range. For example, it is possible to incorporate in the reflective layer a high bromide silver halide emulsion in which the tabular grains in the selected thickness range are precipitated along with other grains. The presence of grains outside the selected thickness range increase total silver coverages and reduce the overall efficiency of the reflective layer. It is therefore preferred to minimize the presence of grains outside the selected thickness range. Preferably the tabular grains in the selected thickness range account for greater than 70 percent of total grain projected area and most preferably greater than 90 percent of total grain projected area in the reflective layer. Since tabular grain emulsions can be readily precipitated with very little variance in tabular grain thickness, it is possible to precipitate tabular grain emulsions in which tabular grains within the selected thickness range account for greater than 99 percent of total grain projected area.

The patent teachings of List T are enabling for the preparation of high bromide tabular grain emulsions for use in the reflective layer, with the following patents particularly teaching high proportions of tabular grains: Saitou et al U.S. Pat. No. 4,797,354; Tsaur et al 5,147,771, '772, '773, 5,171,659, 5,210,013, and Antoniades et al U.S. Pat. No. 5,250,403. Sutton et al U.S. Pat. No. 5,334,469 is an improvement on the teachings of Tsaur et al that further demonstrates selections of tabular grain thicknesses within the selected range.

The silver halide grains in the blue light reflective layer in one specifically contemplated form of the invention do not participate in the formation of a dye image. No latent image is formed in the blue reflective layer when (a) image dye-forming coupler is absent from the reflecting layer and/or (b) the silver halide grains in the reflective layer are not chemically sensitized. Alternatively, it is possible to incorporate image dye-forming coupler and to chemically sensitize the silver halide grains in the blue light reflective layer. In this instance the blue light reflective layer, though participating in latent image formation, exhibits only a low image speed, since it still lacks blue absorbing spectral sensitizing dye. The blue light reflective layer is in all instances slower than the overlying latent image forming layer.

The first latent image forming layer can, if desired, be subdivided into two or more layers, provided the layers together satisfy the requirements of the first layer described above. Similarly, the second latent image forming layer can, if desired, be subdivided into two or more layers, provided the layers together satisfy the requirements of the second layer described above. A third latent image forming layer can, if desired, by located beneath the reflective layer. When the reflective layer does not produce image dye, the third layer is useful in extending the exposure latitude of the blue recording layer unit. The third layer can be constructed similarly as the first and second layers, except that it can have any convenient silver coating coverage found in the slow emulsion layer of "triple coat" layer units (i.e., layer units having fast, mid and slow speed emulsion layers). Generally, the third layer exhibits a speed at least one stop (typically one to three stops) slower than the first latent image forming layer unit.

The remaining features of the color photographic element (I) can take any convenient conventional form. In addition to the silver halide grains and image dye-forming coupler, the blue, green and red recording layer units as well as all other processing solution permeable layers of the color photographic elements, such as the protective overcoat and the antihalation layer unit shown in element (I), contain processing solution permeable vehicle, typically hydrophilic colloid, such as gelatin or a gelatin derivative, as well as vehicle extenders and hardener, examples of which are listed in *Research Disclosure*, Item 38957, II. Vehicles, vehicle extenders, vehicle-like addenda and vehicle related addenda. The layers containing latent image forming silver halide grains additionally usually contain antifoggants and/or stabilizers, such as those listed *Research Disclosure*, Item 38957, VII. Antifoggants and stabilizers. The dye image forming layers can contain in addition to the dye image-forming couplers other dye image enhancing addenda, such as image dye modifiers, hue modifiers and/or stabilizers, and solvents for dispersing couplers and related hydrophobic addenda, summarized in X. Dye image formers and modifiers, sections C, D and E. Colored dye-forming couplers, such as masking couplers, are commonly incorporated in negative-working photographic films, as illustrated in *Research Disclosure*, Item 38957, XII. Features applicable only to color negative.

The antihalation layer unit shown in element (I) is not essential, but is highly preferred to improve image sharpness. The antihalation layer unit can be coated between the red recording layer unit and the transparent film support or, alternatively, coated on the back side of the transparent film support. In addition to vehicle to facilitate coating the antihalation layer unit contains light absorbing materials, typically dyes, chosen to be decolorized (discharged) on processing, a summary of which is provided in *Research Disclosure*, Item 38957, VIII. Absorbing and scattering materials, B. Absorbing materials and C. Discharge.

The protective overcoat is not essential, but is highly preferred to provide physical protection to the blue recording layer unit. In its simplest form the protective overcoat can consist of a single layer containing a hydrophilic vehicle of the type described above. Tide protective overcoat is a convenient location for including coating aids, plasticizers and lubricants, antistats and matting agents, a summary of which is provided in *Research Disclosure*, Item 38957, IX. Coating and physical property modifying addenda. Additionally, ultraviolet absorbers are often located in the protective overcoat, illustrated in *Research Disclosure*, Item 38957, UV dyes/optical brighteners/luminescent dyes. Often the protective overcoat is divided into two layers with the above addenda being distributed between these layers. It is also common practice to place a layer similar to the protective overcoat in the back side of the support containing surface property modifying addenda. When an antihalation layer is coated on the back side of the support, surface modifying addenda are usually incorporated in this layer.

To avoid color contamination of the blue, green and red recording layer units, it is conventional practice to incorporate a oxidized developing agent scavenger (a.k.a. antistain agent) in the layer units to prevent migration of oxidized color developing agent from one layer unit to the next adjacent layer unit. Preferably the oxidized color developing agent is located in a separate layer, not shown in (I) above, at the interface of the layer units. Antistain agents are summarized in *Research Disclosure*, Item 38957, D. Hue modifiers/stabilization, paragraph (2).

It is also preferred to locate a blue filter material, such as a processing solution decolorizable yellow dye or Carey Lea silver, in a layer between the latent image forming grains in the blue recording layer unit and the next adjacent layer unit. These filter materials are also disclosed in *Research Disclosure*, Item 38957, VIII. Absorbing and scattering materials, B. Absorbing materials and C. Discharge.

The reflective layer is specifically identified as a convenient and preferred location for locating antistain agent and blue filter material when the latent image forming grains in the blue recording layer unit lie entirely above (nearer the source of exposing radiation) than the reflective layer. Thus, the reflective layer can be constructed to perform multiple functions to avoid increasing the total number of layers required for color film construction.

The transparent film support can take any convenient conventional form. The film support is generally understood to include subbing layers placed on the film to improve the adhesion of hydrophilic colloid layers. Conventional transparent film support characteristics are summarized in *Research Disclosure*, Item 38957, XV. Supports (2), (3), (4), (7), (8) and (9).

When the color photographic films are intended to be scanned, either for image retrieval or for retrieving information incorporated during manufacture for aiding exposure or processing, they can contain features such as those illustrated by *Research Disclosure*, Item 38957, XIV. Scan facilitating features. When a magnetic recording layer is incorporated in the color film, it is preferably located on the back side of the film support.

The color films of invention are specifically contemplated for use in cameras used to capture visible light images of photographic subjects. Exposures can range from high intensity, short duration exposures to low intensity, long duration exposures. Since the present invention offers the capability of increasing blue speeds, shorter exposures at lower lighting intensities are specifically contemplated. For example, the present invention is particularly suited for producing color films having ISO ratings higher than 200, preferably higher than 400 and optimally higher than 1000. The color films can be employed in cameras intended for repeated use or only limited use (e.g., single-use) cameras.

Contemplated features of limited use cameras are disclosed in *Research Disclosure*, Item 38957, XVI. Exposure, (2).

Once imagewise exposed, the color photographic films of the invention can be processed in any convenient conventional manner to produce dye images that correspond to the latent images in the recording layer units or that are reversals of the latent images. Most commonly, negative-working emulsions are incorporated in the recording layer units which produce a color negative dye image when subjected to a single color development step. If direct-positive emulsions are substituted in the recording layer units, a single color development step produces a positive dye image—i.e., a reproduction of the subject photographed. When negative-working emulsions are incorporated in the recording layer units, reversal processing (black-and-white development followed by color development), is capable of producing a positive dye image. Illustrations of conventional color processing systems are provided by *Research Disclosure*, Item 38957, XVIII. Chemical development systems, B. Color-specific processing systems.

A specifically preferred processing system is the Kodak Flexicolor™ C-41 process. It is specifically contemplated to introduce modifications to the color film and the process to permit development times to less than 2 minutes with improved results, as illustrated by Becher et al U.S. Ser. No. 09/014,842, filed Jan. 28, 1998; U.S. Ser. No. 09/015,720, filed Jan. 29, 1998; and U.S. Ser. No. 09/024,335, filed Feb. 17, 1998; each commonly assigned and currently allowed, here incorporated by reference.

The foregoing discussion of color photographic element (I) and blue recording layer unit (II) requires no further elaboration when each of the blue, green and red recording layer units contain a single latent image forming emulsion layer. In element (I) the green and red recording layer units can each contain two, three or more emulsion layers differing in speed. When the emulsion layer containing grains of maximum sensitivity is coated above the remaining emulsion layers of the recording layer unit, a higher speed is realized than when the emulsions are blended in a single layer. When the emulsion layer containing grains of maximum sensitivity is coated below the remaining emulsion layers of the recording layer unit, a higher contrast is realized than when the emulsions are blended in a single layer.

In the color photographic elements of the invention it is specifically contemplated to coat the reflective layer immediately beneath the emulsion layer containing grains of maximum sensitivity—i.e., the fastest emulsion layer. If one or more additional latent image forming emulsion layers are located in the blue recording layer unit, they are coated beneath the reflective layer. Although the reflective layer will reflect back some of the blue light that might otherwise be available to expose any underlying blue recording emulsion layer or layers, sufficient blue light still passes through the reflective layer to expose the underlying blue recording emulsion layer or layers.

Although it is common practice to locate the green recording layer unit nearer the source of exposing radiation than the red recording layer unit, the positions of the green and red recording layer units in element (I) can be interchanged.

EXAMPLES

The invention can be better appreciated by reference to the following specific embodiments. Component coating coverages, in parenthesis, are reported in units g/m$^2$. Silver halide coating coverages are based on the weight of silver. The suffix E identifies elements as satisfying the requirements of the invention while suffix C identifies comparative elements.

Components Identified by Acronym

YC-1

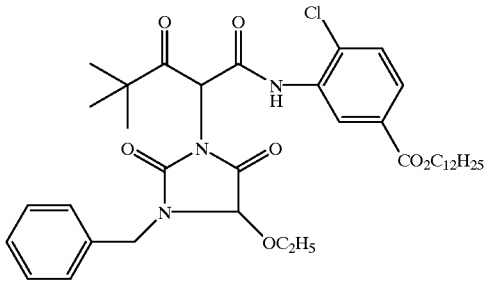

YC-2

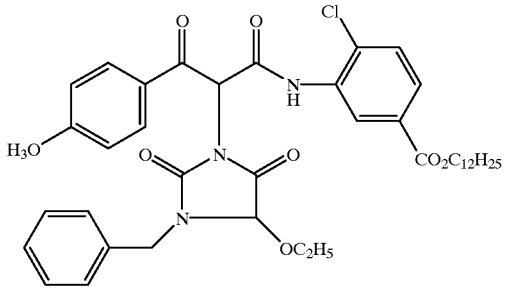

-continued
YFD-1
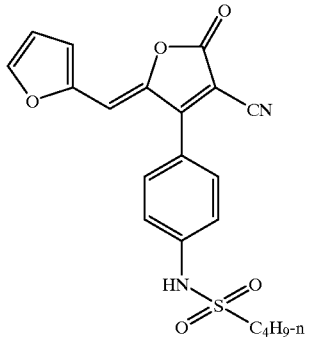
YFD-2
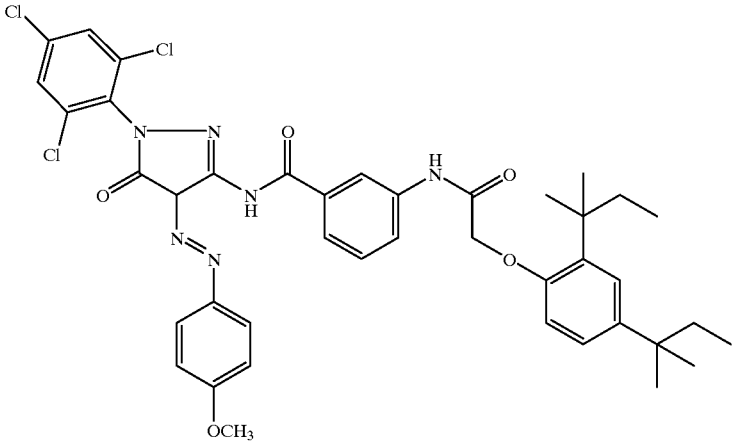
MC-1
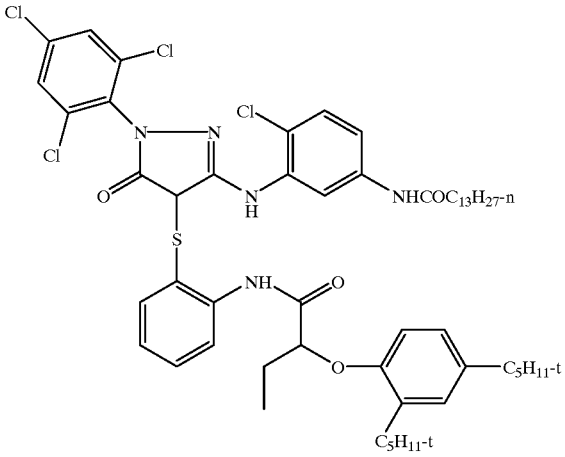

-continued
MC-2
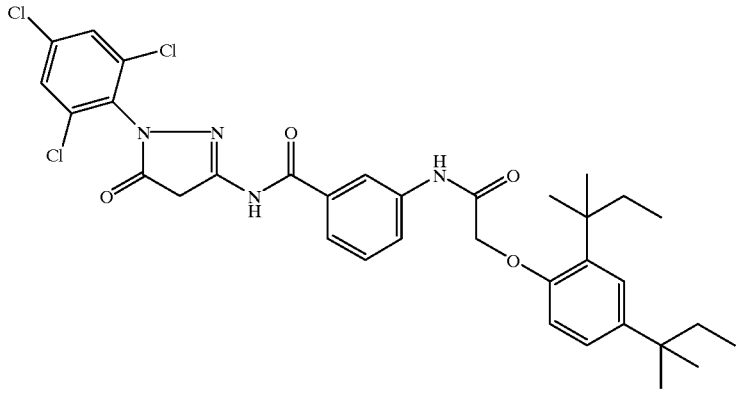
MC-3
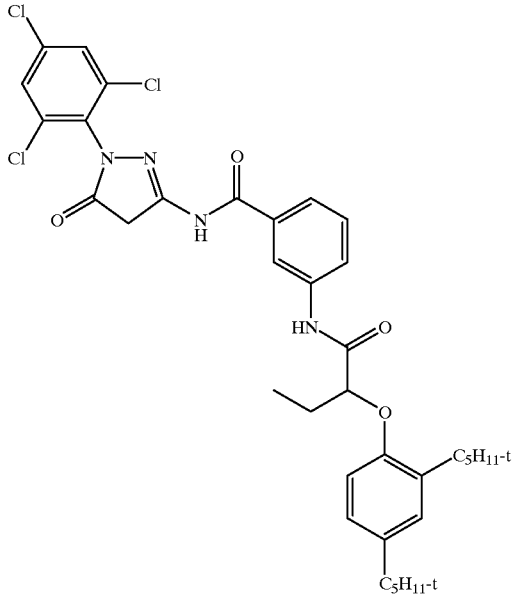
MC-4
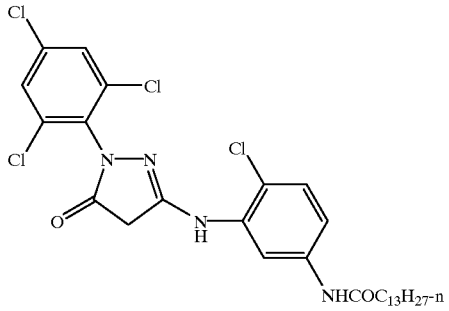

-continued
MM-1
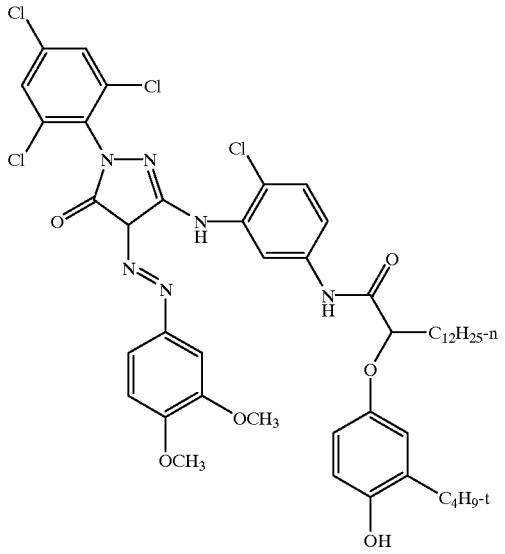
CC-1
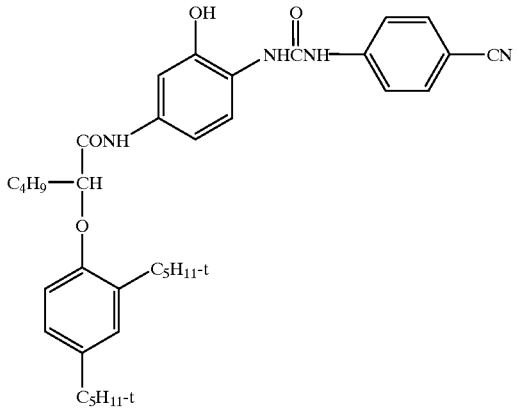
CM-1
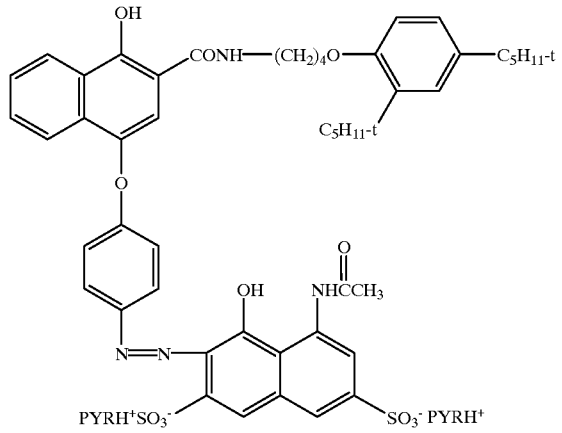

-continued
IR-1
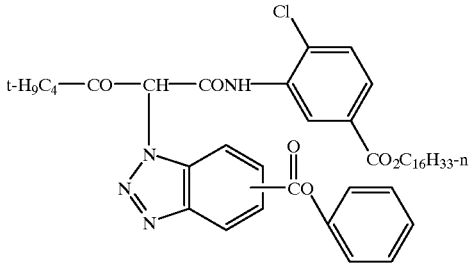
IR-2
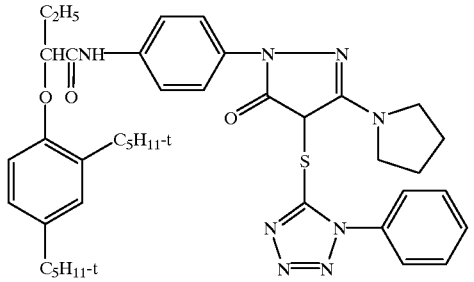
IR-3
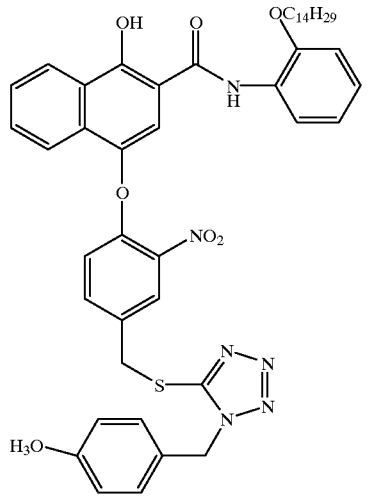
IR-4
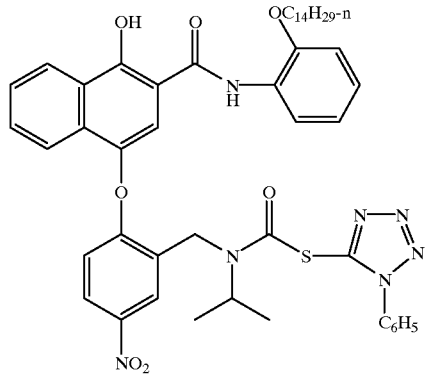

-continued
B-1
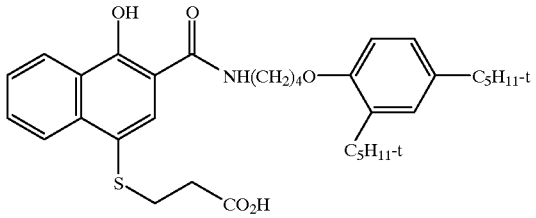
OxDS-1
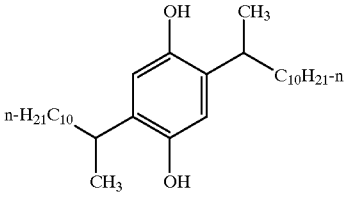
UV-2
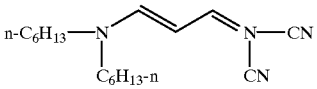
UV-1
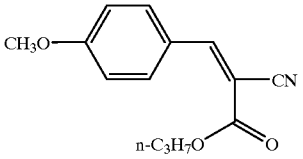
BSD-1
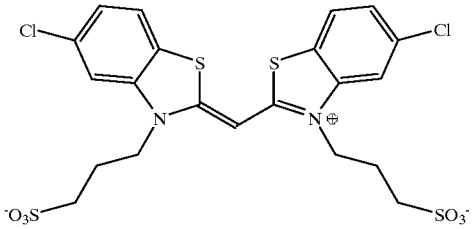
GSD-1
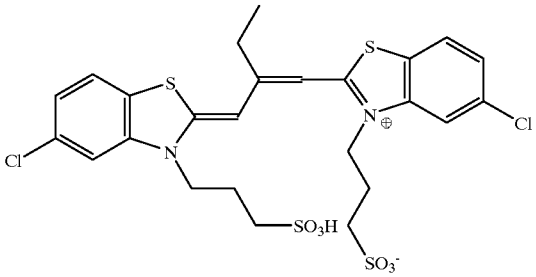
GSD-2
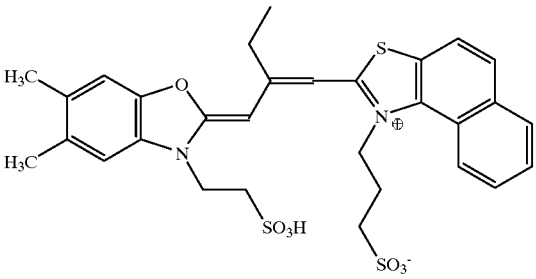

-continued

RSD-1

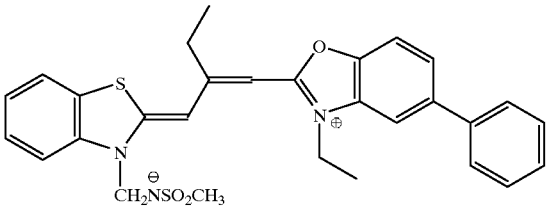

RSD-2

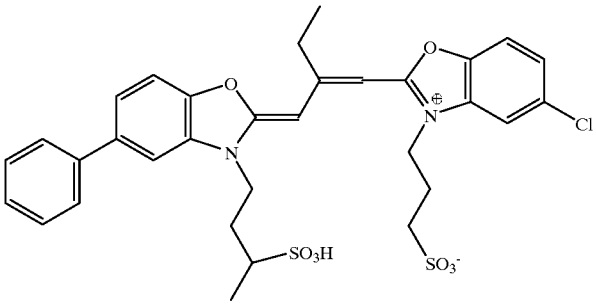

COLOR ELEMENTS

A series of color photographic elements were constructed.

Comparison element 1C was constructed to representative of a conventional photographic element containing in the blue recording layer unit a fast emulsion layer coated over a slow emulsion layer. Element 1C had the layer arrangement shown below, but lacked blue reflective layer, Layer 4B.

Comparison element 2C was constructed to differ from element 1C only by the interchange (inversion) Layers 3 and 4.

Comparison element 3C was constructed as a modification of inverted layer comparison clement 2C that further reduced the silver coverage in the slow blue layer, Layer 4, now coated over the Layer 3. Emulsion (i) in Layer 4 was omitted.

Comparison clement 4C was constructed as a modification of clement 2C that added reflective Layer 4B, the blue reflective layer.

Example element 5E was constructed as a modification of inverted layer comparison clement 3C that added reflective Layer 4B. Thus, only element 5E combined a blue reflective layer and a reduced silver coverage within the range of invention requirements in Layer 4, which, in this arrangement, was the first blue recording layer.

Layer 4B contained gelatin (1.077) and OxDS-1 (0.0154). The grains in Layer 4B were in each instance silver bromide tabular grains, 4.9 μm ECD×0.14 μm t, Ag at (0.86), with tabular grains of the indicated thickness accounting for 99.9 percent of total grain projected area.

The elements were hardened with bis(vinylsulfonyl) methane hardener (0.27) uniformly distributed through all of the gelatin containing layers. The antifoggant 4-hydroxy-6-methyl-1,3,3a,7-tetraazaindene was employed, and the elements contained other conventional addenda that remained unchanged from clement to clement and that did not participate in dye image formation, such as surfactants, high boiling solvents, coating aids, sequestrants, lubricants, matte beads and tinting dyes.

Layer 1 (Protective Overcoat Layer): gelatin at (0.871).

Layer 2 (UV Filter Layer): silver bromide Lippmann emulsion at (0.215), UV-1 at (0.114) and UV-2 at (0.022) and gelatin at (0.860).

Layer 3 (Fast Yellow Layer): a blue sensitized (with BSD-1) silver iodobromide nontabular emulsion, 2 μm ECD, 9 mole % I, based on total Ag, at (1.72), YC-1 at (0.088), YC-2 at (0.234) and gelatin at (2.0).

Layer 4 (Slow Yellow Layer): a blend of two blue sensitized (all with BSD-1) tabular grain silver iodobromidc emulsions (i) 2.7 μm ECD×0.13 μm t, 3.3 mole % I, based on total Ag, at (0.484) and (ii) 1.6 μm ECD×0.13 μm t, 1.3 mole % I, based on total Ag, at (0.323), yellow dye forming coupler YC-1 at (0.464), YC-2 at (0.099), IR-1 at (0.042) and gelatin at (1.58).

Layer 4B Described above.

Layer 5 (Yellow filter layer): YFD-1 at (0.15 1), YFD-2 at (0.043), OxDS-1 at (0.108) and gelatin at (0.645).

Layer 6 (Fast Magenta Layer): a green sensitized (with a mixture of GSD- 1 and GSD-2) silver jodobromide tabular grain silver lodobromide emulsions 3.4 μm ECD×0.11 μm t, 4 mole % iodide, based on Ag, at (1.032), magenta dye forming coupler MC-1 at (0.088), MC-2 at (0.011), MC-3 at (0.003), Masking Coupler MM-1 at (0.022) and gelatin at (1.25).

Layer 7 (Mid Magenta Layer): a green sensitized (with a mixture of GSD-1 and GSD-2) silver iodobromide tabular grain emulsions: (i) 1.2 μm ECD×0.14 μm t, 4.5 mole % iodide, based on Ag, at (1.28), magenta dye forming coupler MC-2 at (0.074), MC-3 at (0.022), MC-4 at (0.106), masking coupler MM-1 at (0.048), IR-2 at (0.010) and gelatin at (1.42).

Layer 8 (Slow magenta layer): a green sensitized (with a mixture of GSD-1 and GSD-2) silver iodobromide tabular grain emulsion: (i) 0.7 μm ECD×0.14 μm t, 0.3 mole % iodide, based on Ag, at (0.484), magenta dye forming coupler MC-2 at (0.069), MC-3 at (0.21), MC-4 at (0.099), Masking Coupler MM-1 at (0.086) and gelatin at (0.914).

Layer 9 (Interlayer): OxDS-1 at (0.110) and gelatin at (1.08).

Layer 10 (Fast Cyan layer): a blend of two red sensitized (with a mixture of RSD-1 and RSD-2) silver iodobromide tabular grain emulsions: (i) 3.0 μm ECD×0.12 μm t, 4.0 mole % I, based on Ag, at (0.634), (ii) 1.3 μm ECD×0.14 μm t, 4.5 mole % I, based on Ag, at (0.333), cyan dye-forming coupler CC-1 at (0.060), yellow dye-forming coupler YC-2 at (0.022), masking coupler CM-1 at (0.027), bleach accelerator releasing coupler B-1 at (0.044) and gelatin at (0.882).

Layer 11 (Slow cyan layer): a blend of two red sensitized (all with a mixture of RSD-1 and RSD-2) silver iodobromide tabular grain emulsions: (i) 1.3 μm ECD×0.14 μm t, 4.5 mole % I, based on Ag, at (0.950) and (ii) 1.0 μm ECD×0.11 μm t, 3.5 mole % I, based on Ag, at (0.674), cyan dye-forming coupler CC-1 at (0.409), yellow dye-forming coupler YC-2 at (0.022), masking coupler CM-1 at (0.011), bleach accelerator releasing coupler B-1 at (0.065), IR-3 at (0.017), IR-4 at (0.026) and gelatin at (1.72).

Support: Cellulose triacetate with a carbon black back layer.

PERFORMANCE COMPARISONS

The elements received identical stepped exposures to allow density (D) versus exposure (log E) characteristic curves to be plotted for each of the blue, green and red color records. The exposed elements were processed in the Kodak Flexicolor™ color negative process described in *British Journal of Photography Annual*, 1988, pp. 196–198.

The blue dye images were analyzed and compared for speed, reported below in relative log units, where a difference in speed of 0.01 log E equals 1 relative log speed unit. Speed was measured at a toe density Ds, where Ds minus Dmin equals 20 percent of the slope of a line drawn between Ds and a point D' on the characteristic curve offset from Ds by 0.6 log E.

The maximum gammas ($\beta_{max}$) of the blue characteristic curves were also compared.

The results are summarized in Table I

TABLE I

| Element | Reflective Layer 4B | Slow Blue Ag Coverage | Δ Blue Speed | γ-max |
|---|---|---|---|---|
| 1C | Absent | (0.807) | Not Appl. | 0.70. |
| 2C | Absent | (0.807) | −29 | 0.94 |
| 3C | Absent | (0.484) | −18 | 0.84 |
| 4C | Present | (0.807) | −21 | 1.09 |
| 5E | Present | (0.484) | +1 | 0.86 |

From Table I it is apparent that simply interchanging the position of (inverting) the fast and slow blue recording emulsion layers from the fast over slow arrangement conventionally employed (element 1C) to a slow over fast arrangement (2C) increases maximum-gamma by 0.24, a significant amount, but costs 29 relative speed units (0.29 log E—i.e., nearly a full stop).

Reducing the silver coating coverage in the overlying, slow blue layer of the inverted blue layer arrangement (3C) costs reduces maximum gamma by 0.10 (almost half the gain realized by inverting the blue emulsion layers) while continuing to cost 18 relative speed units. In other words, the gamma advantage and speed disadvantage, arc both scaled back by about a third.

When a blue reflective layer is added to element 2C (element 4C), maximum gamma is increased, but the speed loss still remains high at 21 relative speed units.

Surprisingly, only when the combination of a lower silver coating coverage in the slow blue emulsion layer and a blue reflective layer are used with the inverted blue emulsion layer arrangement (5E), is a significant increase in maximum gamma retained without a speed loss. Thus, the photographic elements of the invention are capable of producing images of increased contrast with little or no loss of imaging speed. This overcomes one of the major obstacles that has limited the use of slow over fast blue recording emulsion layer arrangements.

The invention has been described in detail with particular reference to certain preferred embodiments thereof, but it will be understood that variations and modifications can be effected within the spirit and scope of the invention.

What is claimed is:

1. A color photographic element comprised of a transparent film support and, coated on the support, blue, green and red recording layer units containing couplers that form first, second and third image dyes, respectively, the blue recording layer unit being coated to receive exposing radiation prior to the green and red recording layer units, each of the layer units containing radiation-sensitive silver halide grains for forming a developable latent image upon imagewise exposure containing greater than 50 mole percent bromide, based on silver, each of the first, second and third image dyes exhibiting a half-peak absorption bandwidth that occupies at least one 25 nm spectral region not occupied by the remaining of the first, second and third image dyes, and wherein, the blue recording layer unit contains at least three layers, first and second layers of the three layers containing the radiation-sensitive silver halide grains for forming a developable latent image in reactive association with the coupler that forms the first image dye, the first layer being positioned to receive exposing radiation prior to the second layer and the radiation-sensitive silver halide grains in the first layer having a lower maximum sensitivity than the radiation-sensitive silver halide grains in the second layer, the silver coating coverage of the first layer being in the range of from 0.1 to 0.7 g/m$^2$, and positioned to receive exposing radiation after the second layer, a blue light reflective layer that is free of blue absorbing dye and contains tabular silver halide grains having a thickness in the range of from 0.12 to 0.15 μm, an average aspect ratio of greater than 15, and a coating coverage of 0.5 to 1.5 g/m$^2$, and formed of greater than 50 mole percent bromide, based on silver.

2. A color photographic element according to claim 1 wherein the silver coating coverage of the first layer being in the range of from 0.2 to 0.6 g/m$^2$.

3. A color photographic element according to claim 1 wherein the tabular silver halide grains in the blue light reflective layer have an average aspect ratio of greater than 20.

4. A color photographic element according to claim 3 wherein the tabular silver halide grains the blue light reflective layer have an average aspect ratio greater than 30.

5. A color photographic element according to claim 1 wherein the silver halide grains in each of the layers contains greater than 70 mole percent bromide, based on silver.

6. A color photographic element according to claim 5 wherein the silver halide grains in each of the layers contains greater than 90 mole percent bromide, based on silver.

7. A color photographic element according to claim 1 wherein the silver halide grains for forming a developable latent image are silver iodobromide grains.

8. A color photographic element according to claim 1 wherein the silver halide grains in the blue light reflective layer are silver bromide grains.

9. A color photographic element according to claim 1 wherein the blue recording layer unit contains a layer containing grains capable of forming a developable latent image and positioned to receive blue light passing through the blue light reflective layer on imagewise exposure.

10. A color photographic element according to claim 1 wherein image dye-forming coupler in the blue recording layer unit forms a yellow image dye, image dye-forming coupler in the green recording layer unit forms a magenta image dye, and image dye-forming coupler in the red recording layer unit forms a cyan image dye.

11. A color photographic element according to claim 1 wherein the blue light reflective layer is free of image dye-forming coupler.

12. A color photographic element according to claim 1 wherein the blue light reflective layer additionally includes a blue filter material.

* * * * *